US008740487B2

(12) United States Patent
Kopel et al.

(10) Patent No.: US 8,740,487 B2
(45) Date of Patent: Jun. 3, 2014

(54) PRINTERS

(75) Inventors: Doron Kopel, Zichron Yaacov (IL); Yaron Dekel, Gan-Yeoshaya (IL); Amit Henig, Herzelia (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 790 days.

(21) Appl. No.: 12/596,393

(22) PCT Filed: May 3, 2007

(86) PCT No.: PCT/US2007/068118

§ 371 (c)(1),
(2), (4) Date: Apr. 14, 2010

(87) PCT Pub. No.: WO2008/136823

PCT Pub. Date: Nov. 13, 2008

(65) Prior Publication Data

US 2010/0186613 A1 Jul. 29, 2010

(51) Int. Cl.
*B41J 11/00* (2006.01)

(52) U.S. Cl.
USPC ..... 400/649; 271/283; 271/276; 271/90; 399/305

(58) Field of Classification Search
USPC ..... 400/649
See application file for complete search history.

(56) References Cited

U.S. PATENT DOCUMENTS

| | | | | |
|---|---|---|---|---|
| 5,216,442 | A | 6/1993 | Parks et al. | |
| 5,287,127 | A * | 2/1994 | Salmon | 347/158 |
| 5,964,568 | A * | 10/1999 | Codatto | 414/751.1 |
| 6,543,948 | B2 * | 4/2003 | Beehler et al. | 400/635 |
| 7,093,931 | B2 * | 8/2006 | Ishii et al. | 347/104 |
| 2002/0110400 | A1 | 8/2002 | Beehler et al. | |

OTHER PUBLICATIONS

International Search Report and Written Opinion of the International Searching Authority; PCT/US2007/068118; Date mailed Nov. 22, 2007.

* cited by examiner

*Primary Examiner* — Matthew G Marini

(57) ABSTRACT

A printer assembly (10) adapted for use with a print head comprising a platen (14) operable to move in a first plane; and a vacuum source in fluid communication with the platen (14) to provide a vacuum communication path to draw air through the platen (14) such that a sheet of media arranged on the platen (14) is biased towards it, characterised by a movable aperture (52) in the vacuum communication path between the vacuum source and the platen (14), the movable aperture (52) being arranged to move with the platen (14).

15 Claims, 9 Drawing Sheets

PRINTERS

FIELD OF THE INVENTION

The present invention relates to improvements in or relating to printers.

BACKGROUND OF THE INVENTION

Large flat bed printers are used for printing on rigid and semi-rigid substrates. A typical flat bed printer has a print head array arranged to move in one direction and a flat bed arranged to move in a direction perpendicular to the direction of movement of the print head. The flat bed might typically have a dimension of 3.2 m×1.65 m and a vacuum is delivered to it to hold the substrate in position during printing. A problem associated with this kind of printer is the need to maintain a constant vacuum over such a large area. The vacuum is required to firmly hold the substrate in position while the flat bed travels a typical distance of 7 m with a speed of approximately 2.5 $m.s^{-1}$ and an acceleration of up to 0.8 $m.s^{-2}$.

In order to provide a firm hold to substrates such as cardboard, Kappa® and vinyl panels a continuous and stable vacuum is typically required of approximately −0.3 bar with a flow rate of 450 $m^{3}.^{-1}$. The vacuum is typically supplied to the flat bed from a vacuum pump using large diameter tubing which is relatively long and which must unfurl as the flat bed travels relative to the vacuum pump. A problem with using such tubing is that it is heavy and significantly increases the flat bed mass. The tubing also causes friction due to the requirement to continuously move the flat bed. A powerful drive must typically be used to operate the flat bed, which is expensive and requires a large amount of energy. Such a powerful drive may also be noisy. The need for the tubing to travel with the flat bed also produces undesirable vibrations which can degrade the print quality. There are also maintenance problems with the large diameter tubing which may crack or split. Overall a lighter bed is more desirable due to the above mentioned problems.

SUMMARY OF THE INVENTION

The invention provides a printer assembly adapted for use with a print head comprising a platen operable to move in a first plane; and a vacuum source in fluid communication with the platen to provide a vacuum communication path to draw air through the platen such that a sheet of media arranged on the platen is biased towards it; characterised by a movable aperture in the vacuum communication path between the vacuum source and the platen, the movable aperture being arranged to move with the platen.

The invention also provides a method of supporting and holding media to be printed upon using a printer having a platen which is operable to move in a first plane, the method comprising: applying a vacuum to create a vacuum communication path to draw air through the platen such that a sheet of media arranged on the platen is biased towards it; characterised in that the method includes: moving the platen to generate a movable aperture in the vacuum communication path, the movable aperture being arranged to move with the platen.

The invention further provides a method of printing using a printer having a platen which is operable to move in a first plane, the method comprising: applying a vacuum to create a vacuum communication path to draw air through the platen; and printing on the media whilst it is held in position on the platen by the vacuum; characterised in that the method includes: moving the platen to generate a movable aperture in the vacuum communication path, the movable aperture being arranged to move with the platen.

The invention also provides use of a hollow profile and a carriage in a printer to generate a movable aperture for communicating a vacuum from a vacuum source to a platen of the printer.

The invention also provides a carriage which is arranged to move in a first plane and arranged to create a movable aperture in a vacuum communication path.

The invention also provides a hollow profile to provide a vacuum communication path and arranged to create a movable aperture in the vacuum communication path.

BRIEF DESCRIPTION OF THE DRAWINGS

The present invention will be apparent from the following description of preferred embodiments shown by way of example only in the accompanying drawings, of which.

DETAILED DESCRIPTION OF EMBODIMENTS OF THE INVENTION

Figure 1:
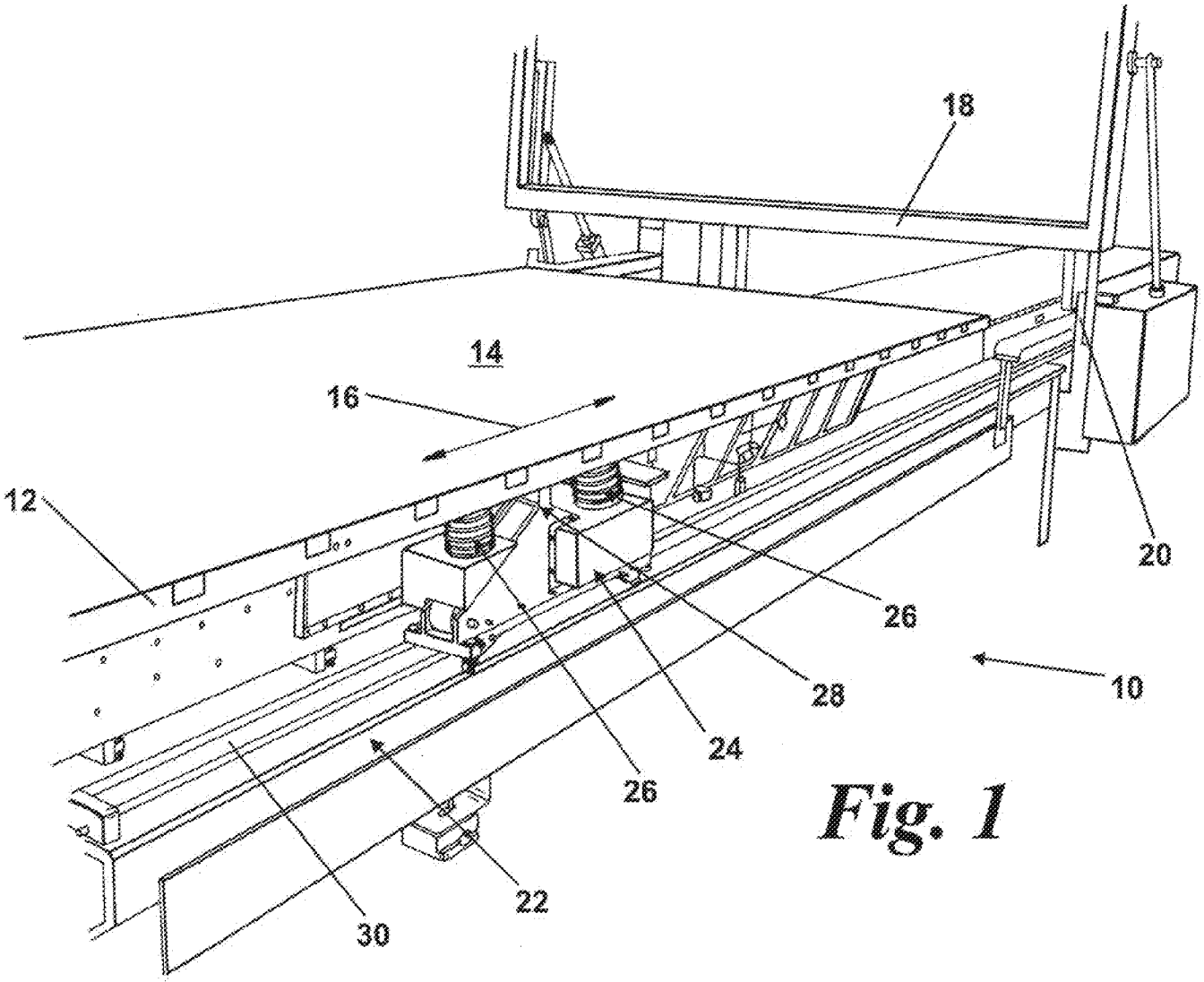
FIG. 1 is a perspective diagram of a flat bed printer according to an embodiment of the present invention.

Referring to FIG. 1 there is shown a perspective diagram of a flat bed printer according to an embodiment of the present invention, generally designated 10. The flat bed printer 10 has a platen assembly 12 with a flat upper surface 14 which is arranged to move in a fore and aft direction indicated by arrow 16. A printer head 18 is mounted on a frame 20 and is a fixed printer head which is approximately the same width as the platen assembly 12. A vacuum pump (not shown in FIG. 1) to provide a vacuum source is in fluid communication with the platen assembly 12 to draw air into the upper surface of the platen as discussed below. The air enters the platen assembly 12 through small holes in the flat upper surface 14 such that media arranged on the flat upper surface are biased towards the platen by air pressure pressing on the media and because of the vacuum. It will be appreciated that the flat upper surface 14 could be any perforated or porous sheet having a low air flow resistance. Once the media is held in place it can be printed upon using the printer head 18 as required by moving the platen assembly 12 in the fore and aft direction 16

Figure 3:
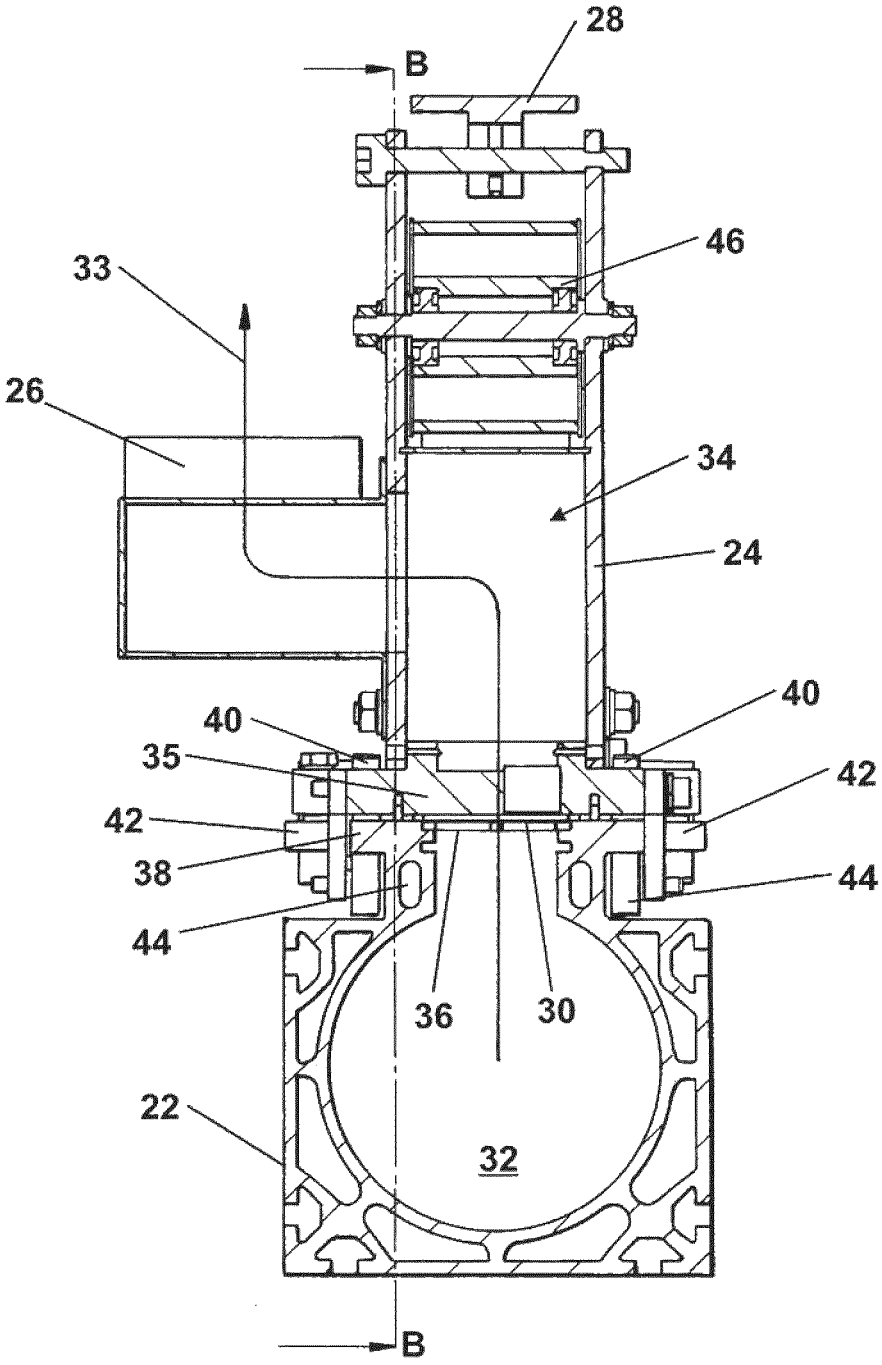
FIG. 3 is a diagram of the vacuum delivery carriage and hollow profile of FIG. 2 taken along line A-A.

The flat bed printer 10 includes a hollow profile 22 which has a profile chamber 32 as shown in FIG. 3. The hollow profile 22 is a beam or bed having a vacuum defining chamber 32. The hollow profile 22 is a way of delivering the vacuum to the platen assembly 12 and is also support for the vacuum delivery carriage 24. In FIG. 1 the hollow profile 22 has a vacuum delivery carriage 24 arranged to ride on it. The vacuum delivery carriage 24 has a carriage chamber 34 (best shown in FIG. 3) which is in fluid communication with the platen assembly 12 of FIG. 1 via a pair of short flexible tubes 26 to deliver the vacuum to the flat upper surface 14 from the vacuum pump as discussed below. A mechanical connection 28 is provided on the vacuum delivery carriage 24 to connect the platen assembly 12 to the vacuum delivery carriage 24 so that when the platen assembly 12 is operated in the fore and aft direction 16 the vacuum delivery carriage 24 moves with it.

An overview of the disclosed embodiments is that a vacuum is applied to an inside of a hollow profile 22 which has a slot along a top edge. A band closes the slot to form a seal and to maintain a vacuum within the hollow profile. A movable carriage lifts the band to create a moving hole where the vacuum exists. The hole moves with the platen assembly 12 and moves relative to the print head. This allows short vacuum supply tubes to be used to connect the movable carriage to the platen assembly 12 and avoids the use of long heavy tubes which are required to fold against themselves in a serpentine manner. Overall the disclosed embodiments provide a lighter platen assembly 12.

The carriage chamber 34 of the vacuum delivery carriage 24 is in fluid communication with the profile chamber 32 of the hollow profile 22. One end of the hollow profile 22 is closed whereas the other end of the hollow profile 22 is in fluid communication with the vacuum pump. In this manner a vacuum path (shown at 33 in FIG. 3) travels from the vacuum pump, through the profile chamber 32 of the hollow profile 22, through the carriage chamber 34 of the vacuum delivery carriage 24, through the short flexible tubes 26 and to the flat upper surface 14 of the platen assembly 12.

The hollow profile 22 is open at a top edge thereof adjacent to where the vacuum delivery carriage 24 rides and delivers the vacuum from the profile chamber 32 to the carriage chamber 34. The opening at the top edge of the hollow profile 22 forms an elongate opening in the hollow profile 22. A thin metal or plastic band 30 is also shown in FIG. 1 which is arranged to close the elongate opening of the hollow profile 22. The band is threaded through the vacuum delivery carriage 24 as discussed below. The band 30 is an elongate seal or strip to close the top of the hollow profile 22.

Figure 2:
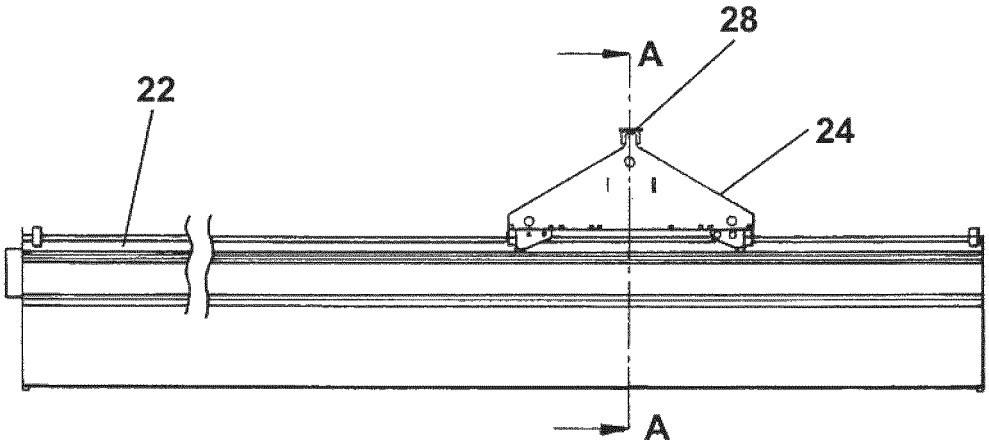
FIG. 2 is a diagram of a vacuum delivery carriage and hollow profile of FIG. 1 shown in section.

FIG. 2 is a diagram of the vacuum delivery carriage 24 and the hollow profile 22 of FIG. 1 shown in section. The mechanical connection 28 is also shown which causes the vacuum delivery carriage 24 to move with the platen assembly 12. In FIG. 2 the vacuum delivery carriage 24 is shown in situ on the hollow profile 22.

FIG. 3 is a diagram of the vacuum delivery carriage 24 and hollow profile 22 of FIG. 2 taken along line A-A in FIG. 2. In FIG. 3 the profile chamber 32 and the carriage chamber 34 are shown in fluid communication through a gasket 35. The vacuum flow path is also shown at 33 whereby the profile chamber 32 is shown in fluid communication with the carriage chamber 34 which is in turn in fluid communication with the short flexible tubes 26 to deliver the vacuum to the platen assembly 12. The band 30 is also shown supported by a rigid net 36. The rigid net 36 rests on shoulders 38 of the hollow profile 22 and inhibits the band 30 from buckling due to atmospheric pressure when the vacuum is applied. In use, the vacuum causes atmospheric pressure to clamp the band 30 to the hollow profile 22 which further reduces leaks.

FIG. 3 shows three bearings 40, 42, 44 on the right-hand side of the vacuum delivery carriage 24 as seen in FIG. 3. The first bearing 40 is arranged to roll on an upper surface of the shoulder 38 and to rotate about a horizontal axis. The second bearing 42 is arranged to roll on a side edge of the shoulder 38 and to rotate about a vertical axis. The third bearing 44 is arranged to roll on an under surface of the shoulder 38 and to rotate about a horizontal axis. The three bearings 40, 42, 44 on the right-hand side of the vacuum delivery carriage 24 are mirrored by similar bearings 40, 42, 44 on the left-hand side of the vacuum delivery carriage 24. FIG. 3 shows bearings 40, 42, 44 at one end of the vacuum delivery carriage 24, but it will be described below with reference to FIGS. 8-10 that similar bearings 40, 42, 44 are also provided at the other end of the vacuum delivery carriage 24. The bearings 40, 42, 44 allow the vacuum delivery carriage 24 to ride on the hollow profile 22 and inhibit the vacuum delivery carriage 24 from rotating relative to the hollow profile 22 when it is moved along the hollow profile 22 by the platen assembly 12. A gasket 35 is also provided between the vacuum delivery carriage 24 and the hollow profile 22 to seal the vacuum delivery carriage 24 to the hollow profile 22 as it travels along the hollow profile 22. The bearings 40, 42, 44 are tensioned against the hollow profile and the gasket 35 to provide relatively free and smooth movement of the vacuum delivery carriage 24 whilst also inhibiting air leaking into the profile chamber 32 and the carriage chamber 34. The gasket 35 is made of a low friction material such as polypropylene to allow it to slide along the shoulder 38 of the hollow profile 22 with minimal wear.

FIG. 3 further shows an upper band roller 46 which is arranged to allow the band 30 to pass over it. This upper band roller 46 is described in greater detail with reference to FIG. 4.

Figure 4:
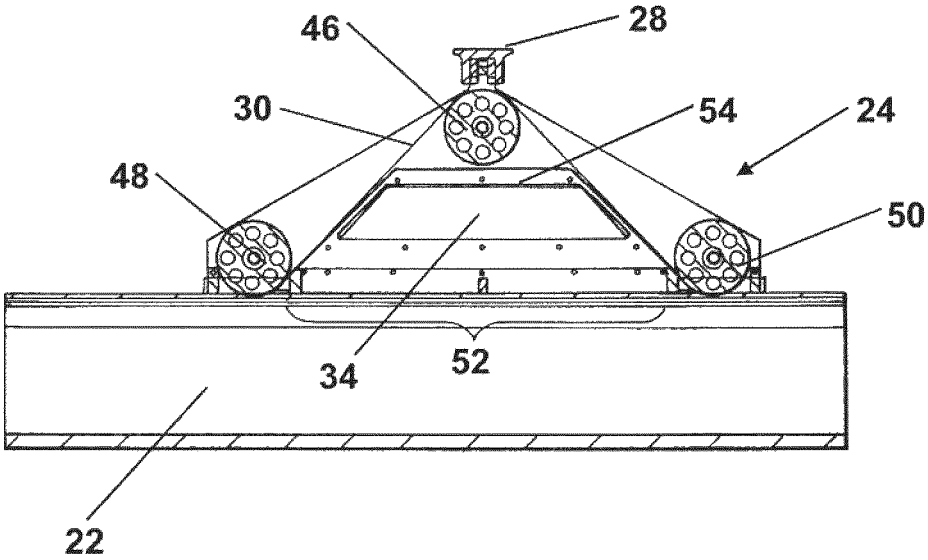
FIG. 4 is a diagram of the vacuum delivery carriage and hollow profile of FIG. 3 shown in section along line B-B.

FIG. 4 is a diagram of the vacuum delivery carriage 24 and the hollow profile 22 of FIG. 3 shown in section along line B-B. FIG. 4 shows the upper band roller 46 and two lower band rollers 48 and 50 at either end of the vacuum delivery carriage 24. The band 30 is threaded around the band rollers 46, 48, 50 such that it passes underneath the lower band rollers 48, 50 and on top of the upper band roller 46. The lower band rollers 48, 50 press the band 30 to the hollow profile 22 whereas the upper band roller 46 lifts the band 30 to provide a movable opening or movable aperture 52 in the hollow profile 22. The movable opening 52 is such that as the vacuum delivery carriage 24 travels back and forth the movable opening 52 travels with it because the upper band roller 46 lifts the band 30. It will be appreciated that the upper band roller 46 lifts the band 30 into the carriage chamber 34 and a side opening 54 in a wall of the vacuum delivery carriage 24 provides the carriage chamber 34 in fluid communication with the short flexible tubes 26 to deliver the vacuum to the platen assembly 12.

Figure 5:
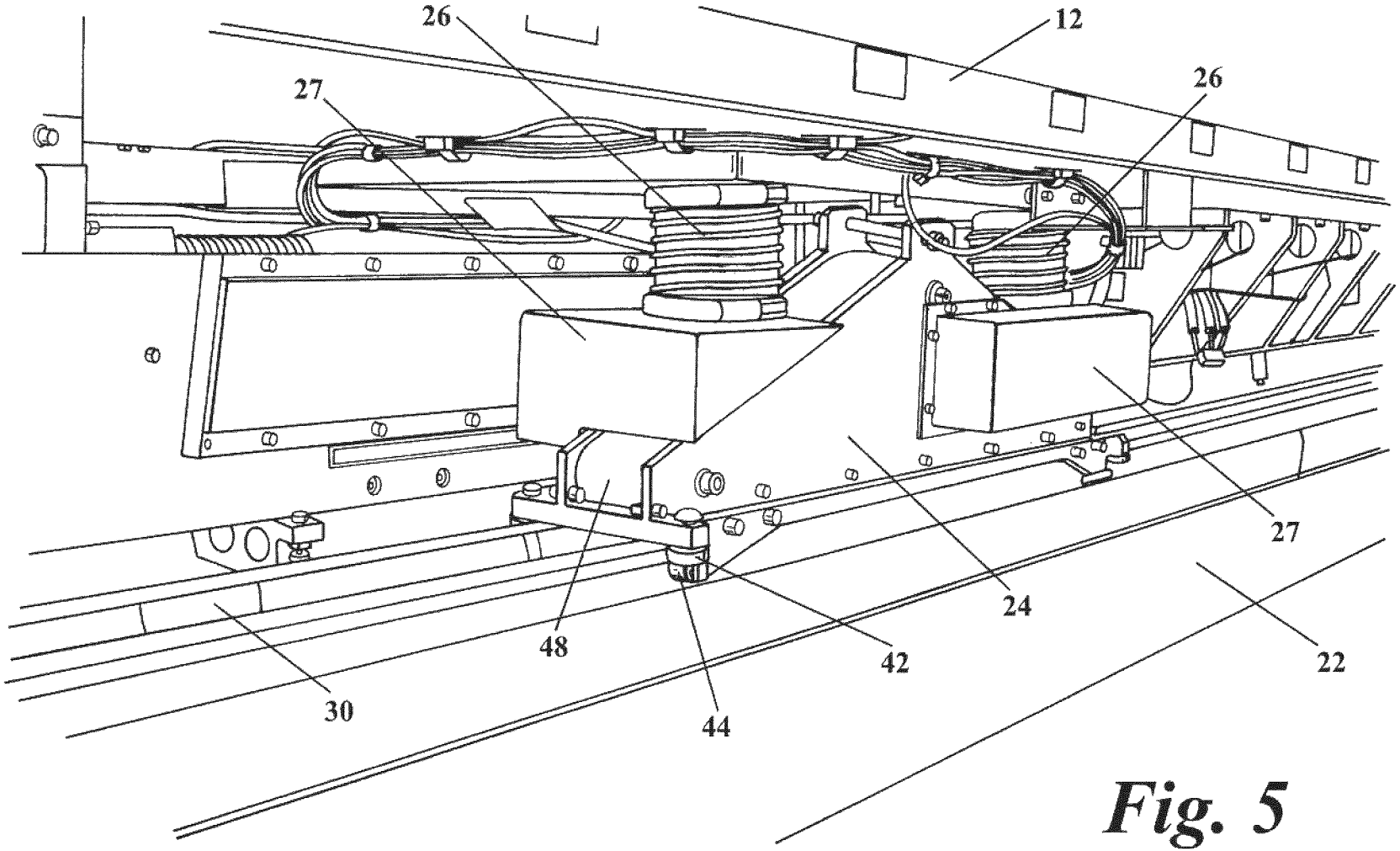
FIG. 5 is a perspective diagram of the vacuum delivery carriage and hollow profile shown in FIGS. 1-4.

FIG. 5 is a perspective diagram of the vacuum delivery carriage 24 and hollow profile 22 shown in FIGS. 1-4. In FIG. 5 the short flexible tubes 26 are shown at either end of the vacuum delivery carriage 24 for provide the carriage chamber 34 and the platen assembly 12 in fluid communication with one another. Each short flexible tube 26 is shown in fluid communication with a respective vacuum delivery box 27 on either side of the vacuum delivery carriage 24. Each vacuum delivery box 27 is in fluid communication with the carriage chamber 34. The band 30 is also shown on top of the hollow profile 22 and can be seen passing underneath one of the lower band rollers 48.

Figure 6:
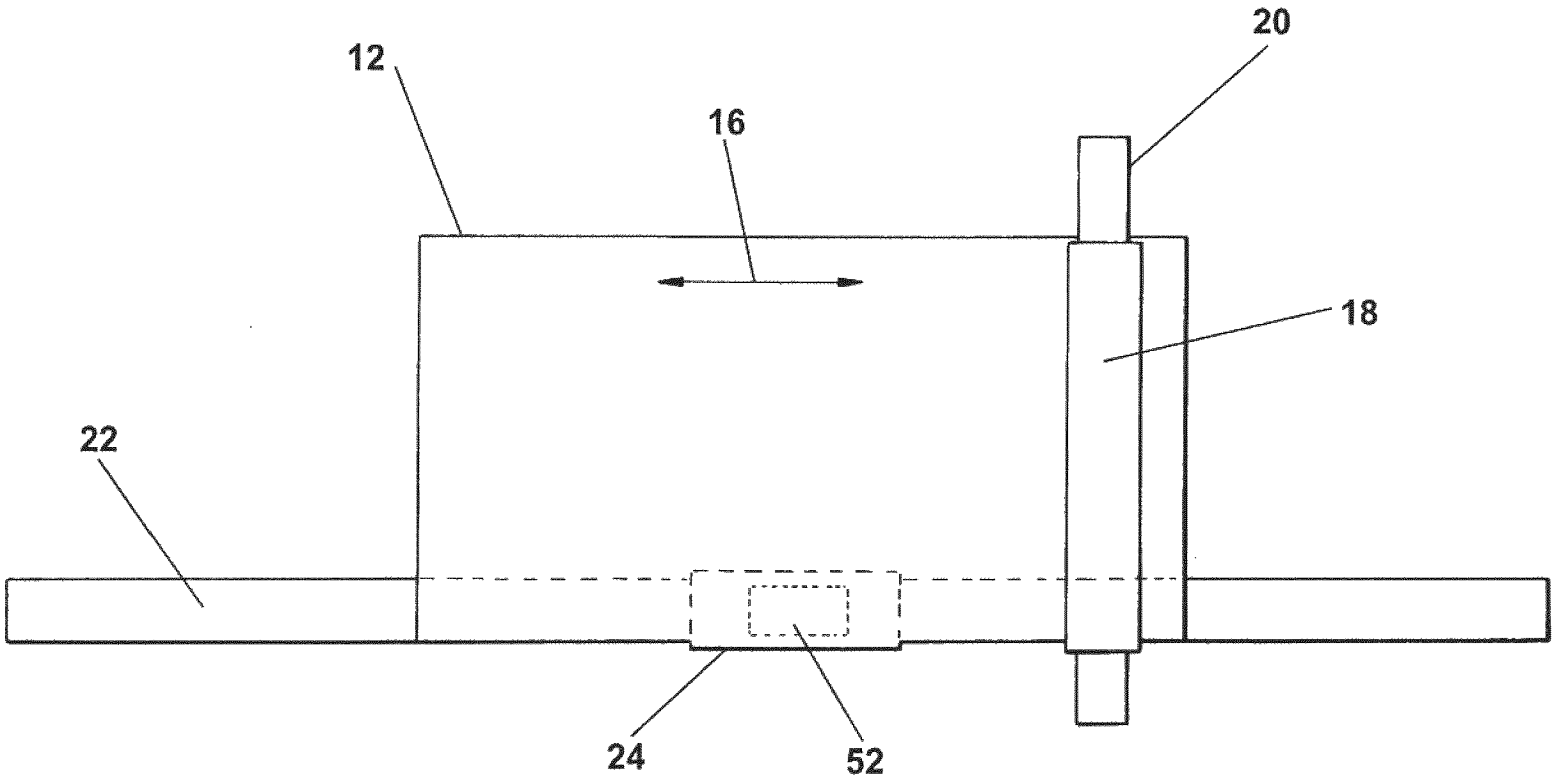
FIG. 6 is a plan view of the printer shown in FIG. 1.

FIG. 6 is a plan view of the printer 10 shown in FIG. 1 and shows the platen assembly 12 which is operable to move in a fore and aft direction 16. The frame 20 is also shown having the fixed printer head 18 mounted on it. The hollow profile 22 is also shown which has the vacuum delivery carriage 24 arranged to move thereon. It will be appreciated that the hollow profile 22 and the frame 20 are stationary whilst the platen assembly 22 and the vacuum delivery carriage 24 move together in the fore and aft direction 16. The movable opening 52 is also shown between the vacuum delivery carriage 24 and the hollow profile 22. It will also be appreciated that the movable opening 52 moves with the vacuum delivery carriage 24 and the platen assembly 12 in the fore and aft direction 16.

Figure 7:
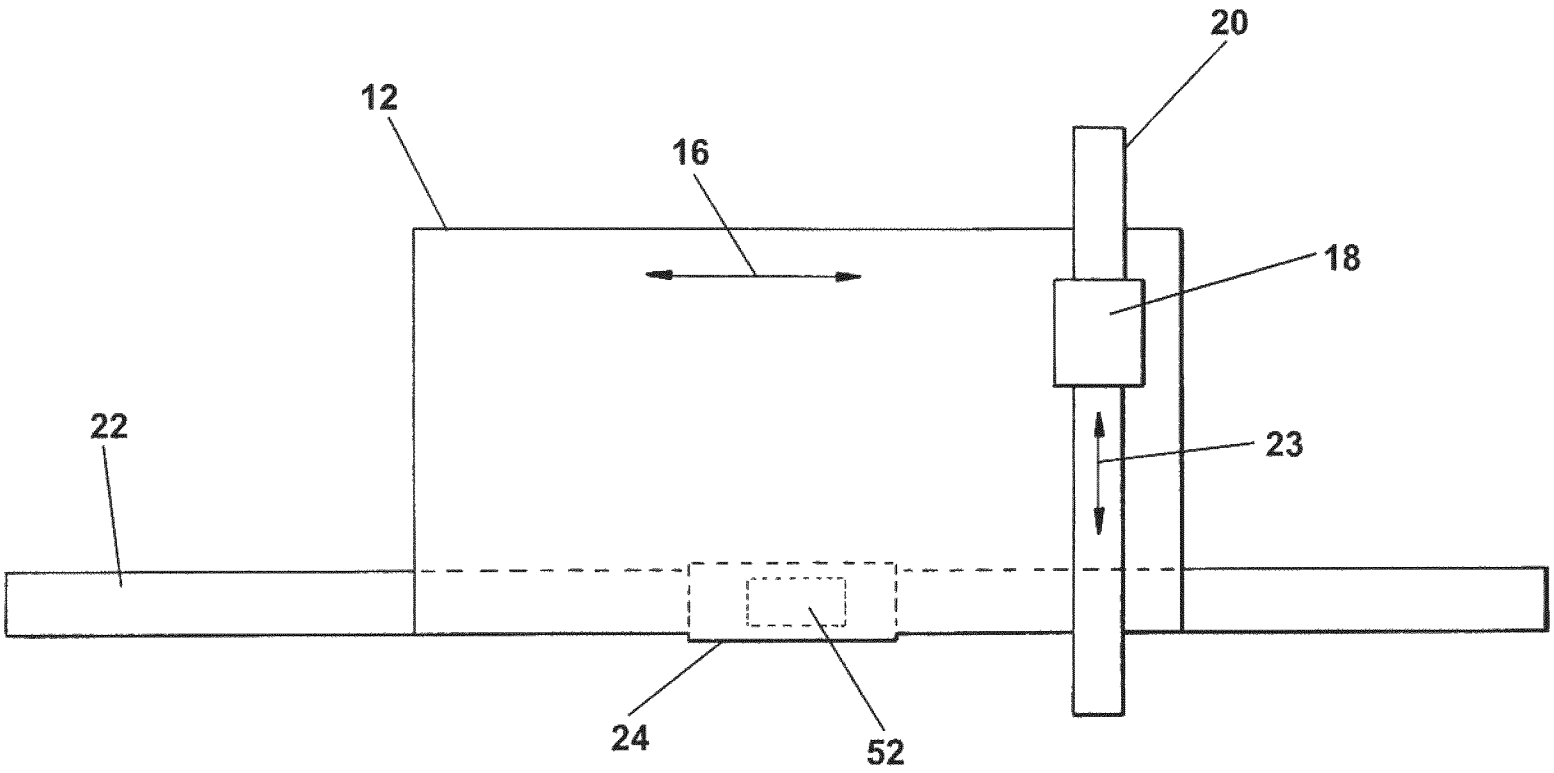
FIG. 7 is a plan view of the printer shown in FIG. 1 with a different printer head arrangement.

FIG. 7 is a plan view of the printer shown in FIG. 1 with a different printer head arrangement. In FIG. 7 the printer head 18 is arranged to move on the frame 20 in a transverse direction 23 which is perpendicular to the fore and aft direction 16.

Figure 8:
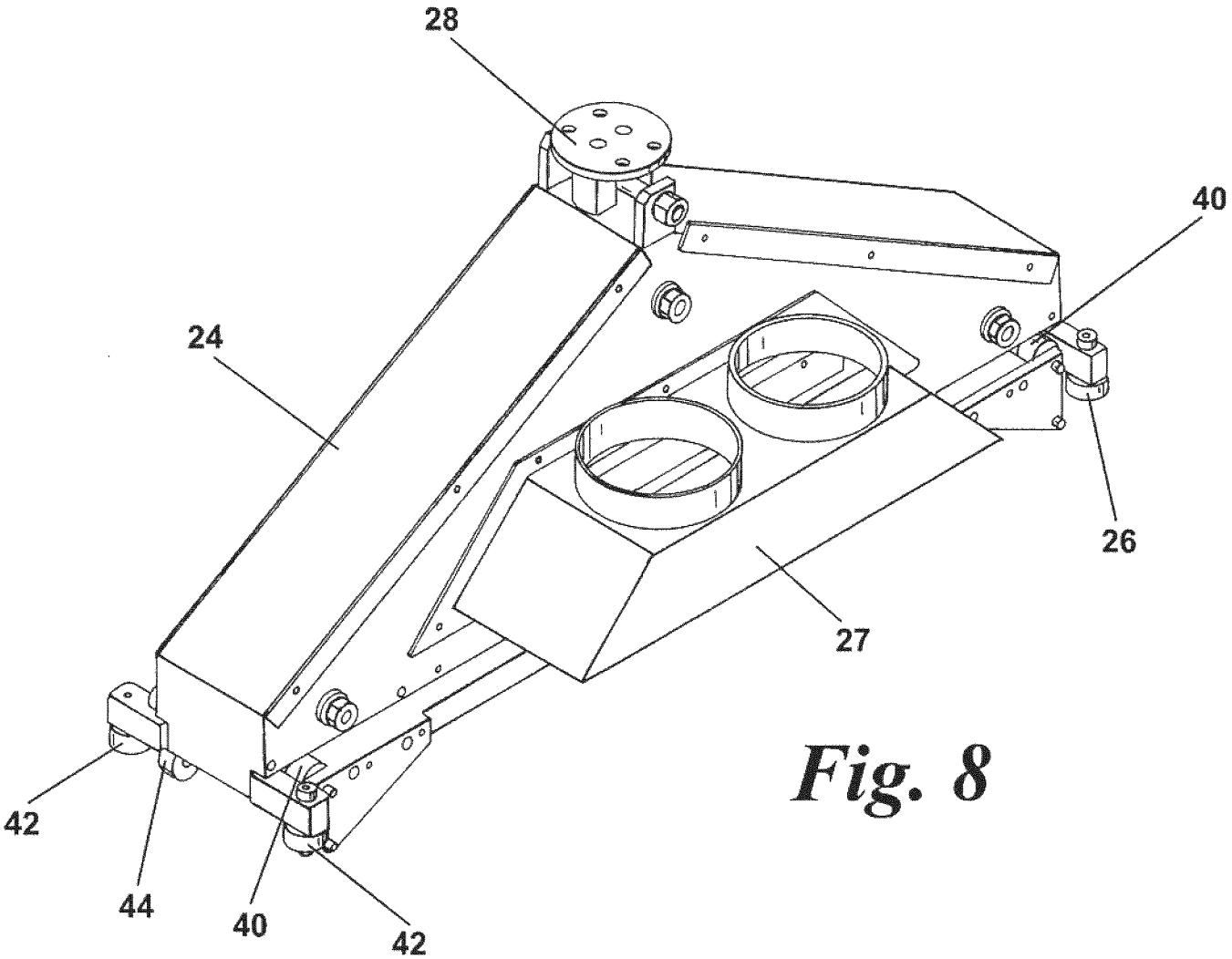
FIGS. 8-10 are perspective diagrams of the vacuum delivery carriage shown in FIGS. 1-5 according to an alternative embodiment.
Figure 9:
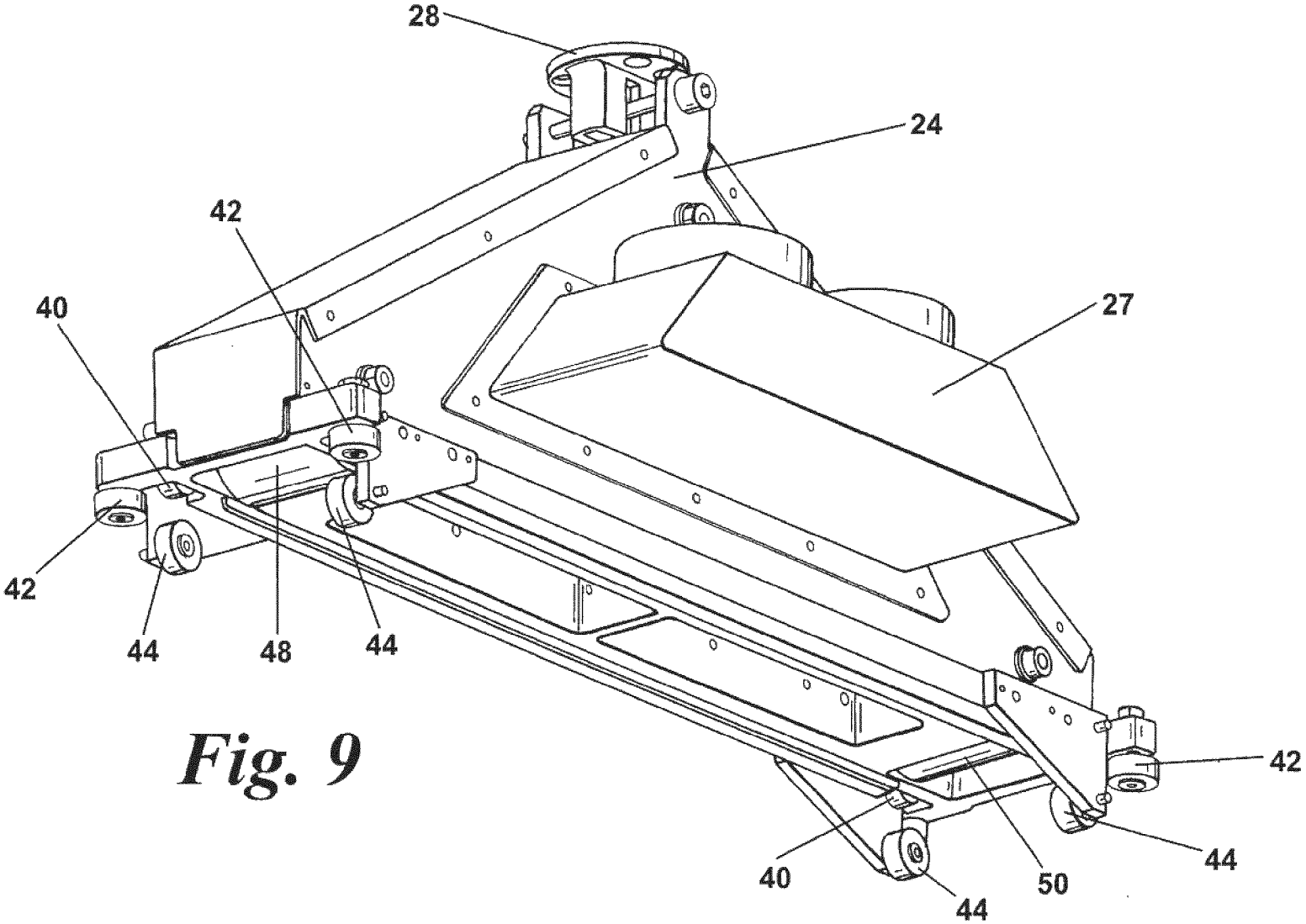
Figure 10:
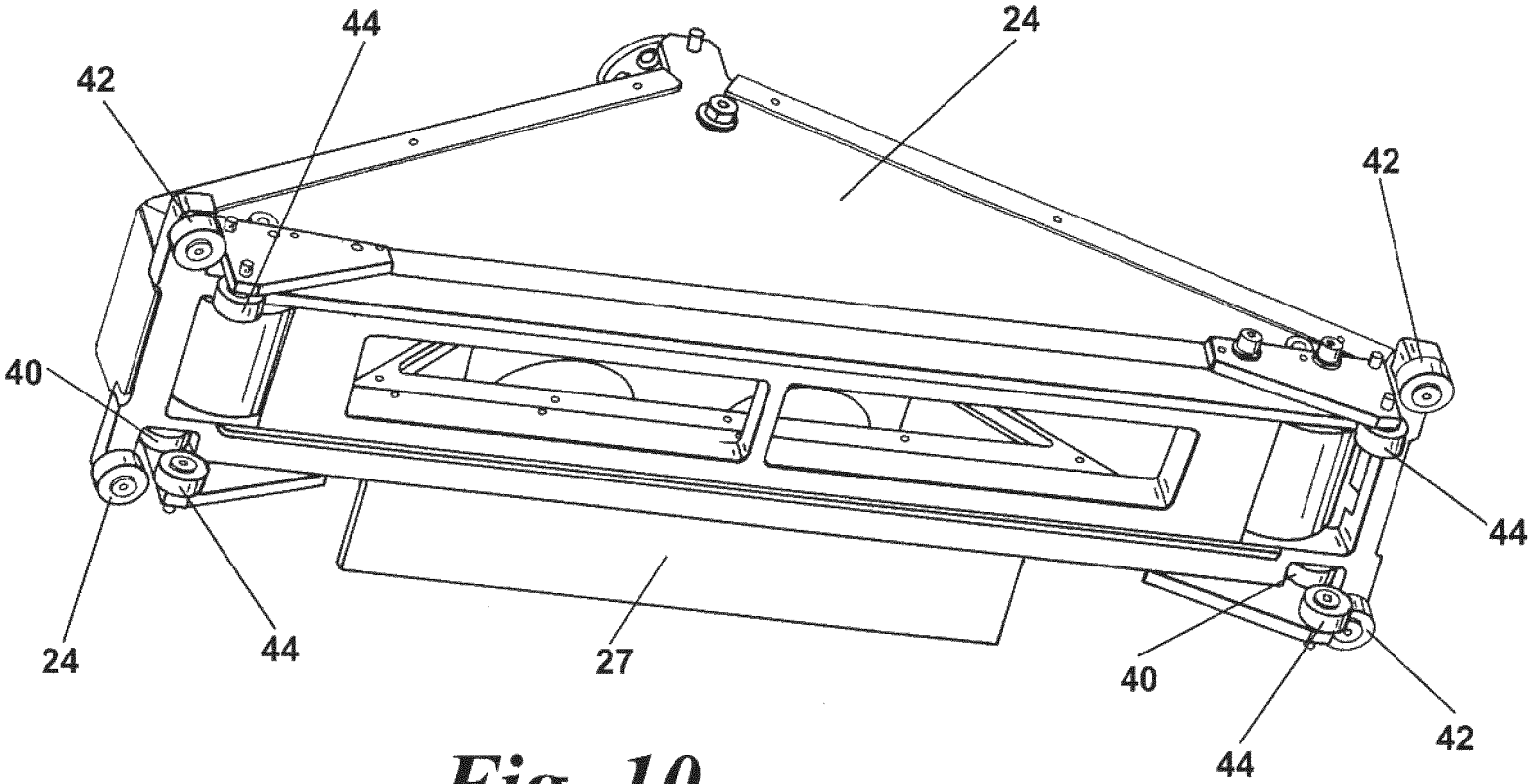

FIGS. 8-10 are perspective diagrams of the vacuum delivery carriage shown in FIGS. 1-5 and show an alternative way of providing the two short flexible tubes 26 in communication with the platen assembly 12. In FIGS. 8-10 the vacuum delivery carriage 24 is shown with a single vacuum delivery box 27 on one side of it. The single vacuum delivery carriage 27 is arranged for the two short flexible pipes 26 to be connected to it.

FIGS. 8-10 also show the arrangement of the bearings 40, 42, 44 at the front and the back of the vacuum delivery carriage 24 such that there are three bearing 40, 42, 44 at each corner of the vacuum delivery carriage 24. In total there are twelve bearings 40, 42, 44 which restrain the vacuum delivery carriage 24 to travel along the hollow profile 22. In use the four bearings 42 which rotate about a vertical axis and roll against a side edge of the shoulder 38 inhibit the vacuum delivery carriage 24 from falling off the hollow profile 22 as it travels along the hollow profile 22. In use the four bearings 40 arranged to roll on an upper surface of the shoulder 38 and the four roller bearings 44 arranged to roll on an under surface of the shoulder 38 inhibit the vacuum delivery carriage from rotating about a horizontal axis as it travels along the hollow profile 22.

A flat bed printer so arranged minimises or at least ameliorates the problems associated with using relatively long and large diameter tubes associate with the prior art to deliver the vacuum to the platen. A flat bed printer arranged according to the herein described embodiments eliminates the need for such large diameter and heavy tubing for delivering the vacuum to the platen assembly. Maintenance problems due to the prior art tubes cracking are also eliminated. Accordingly the mass of the flat bed is significantly reduced using the hollow profile 22 and vacuum delivery carriage 24 of the above embodiments. Overall the platen assembly 12 of the herein described embodiments is therefore lighter and the force, and hence motor power required to operate the flat bed printer may be reduced. A smaller motor may be used. Embodiments of the invention may provide a quieter printer which consumes less power. A further advantage of the above-described embodiments is that the vibrations are reduced when compared to the printer of the prior art which leads to an improved print quality.

It will be appreciated by persons skilled in the art that the present invention is not limited to what as been particularly shown and described above. Rather, the scope of the present invention is defined by the claims that follow.

The invention claimed is:

1. A print assembly adapted for use with a print head comprising:

a platen operable to move in a first plane; and a vacuum source in fluid communication with the platen to provide a vacuum communication path to draw air through the platen such that a sheet of media arranged on the platen is biased towards it;

characterized by a movable aperture in the vacuum communication path between the vacuum source and the platen, the movable aperture being arranged to move with the platen and wherein the movable aperture is provided by a hollow profile and a carriage which is movable on the hollow profile, where the hollow profile and carriage are separate from the plate and are located between the platen and the vacuum source;

wherein the carriage is movable with the platen and arranged to create the movable aperture in the hollow profile as it moves on the hollow profile;

wherein the hollow profile has an elongate opening having a band to close it at least partially, the carriage operable to separate the band from the hollow profile to provide the movable aperture.

2. A printer assembly according to claim 1 and further including a gasket between the carriage and the hollow profile.

3. A printer assembly according to claim 1 wherein the carriage is provided with at least one bearing to reduce friction when the carriage moves on the hollow profile.

4. A printer assembly according to claim 3 wherein at least one bearing constrains the carriage in a lateral direction relative to the hollow profile.

5. A printer assembly according to claim 3 wherein least one bearing constrains the carriage from rotating relative to the hollow profile.

6. A printer assembly according to claim 1 wherein the carriage is further provided with at least one band roller which contacts the band.

7. A printer assembly according to claim 6 wherein at least one band roller is arranged to separate the band from the hollow profile to provide the movable aperture.

8. A printer assembly according to claim 6 wherein least one band roller is arranged to urge the band against the hollow profile.

9. A printer assembly according to claim 1 and further including a print head adapted to move in a transverse direction relative to the platen.

10. A printer assembly according to claim 1 and further including a fixed print head substantially the same length as the width of the platen.

11. A method of supporting and holding media to be printed upon using a printer having a platen which is operable to move in a first plane, the method comprising:

applying a vacuum to create a vacuum communication path to draw air through the platen such that a sheet of media arranged on the platen is biased towards it, the vacuum communication path located between a vacuum source and the platen;

characterized in that the method includes:

moving the platen to generate a movable aperture in the vacuum communication path, the movable aperture being arranged to move with the platen and wherein the movable aperture is provided by a hollow profile and a carriage which is movable on the hollow profile, where the hollow profile and carriage are not part of the platen and are located between the platen and the vacuum source;

using an elongate opening in the hollow profile which is at least partially closed by a band; and separating the band from the hollow profile to generate the movable aperture.

12. A method according to claim 11 and further including constraining the carriage to move relative to the hollow profile using at least one bearing.

13. A method according to claim 11 and further including urging the band against the hollow profile.

14. A method of printing comprising supporting media according to claim 11 and further including printing on the media using a print head.

15. A method of printing using a printer having a platen which is operable to move in a first plane, the method comprising:

applying a vacuum to create a vacuum communication path to draw air through the platen; and printing on the media whilst it is held in position on the platen by the vacuum;

characterized in that the method includes:

moving the platen to generate a movable aperture in the vacuum communication path, the movable aperture being arranged to move with the platen, the vacuum communication path located between a vacuum source and the platen and wherein the movable aperture is provided by a hollow profile and a carriage which is movable on the hollow profile, where the hollow profile and carriage are not part of the platen and are located between the platen and the vacuum source;

using an elongate opening in the hollow profile which is at least partially closed by a band; and separating the band from the hollow profile to generate the movable aperture.

* * * * *